US005121922A

United States Patent [19]

Harsh, Sr.

[11] Patent Number: 5,121,922

[45] Date of Patent: Jun. 16, 1992

[54] GOLF CLUB HEAD WEIGHT MODIFICATION APPARATUS

[76] Inventor: Ronald L. Harsh, Sr., 305 Mulberry Cir., Broomfield, Colo. 80020

[21] Appl. No.: 715,688

[22] Filed: Jun. 14, 1991

[51] Int. Cl.[5] ..... A63B 53/04; A63B 53/08

[52] U.S. Cl. ..... 273/164; 273/170; 273/171

[58] Field of Search ..... 273/167-175, 273/77 R, 164, 193 R, 194 B, 183 D, 186 A, 194 R

[56] References Cited

U.S. PATENT DOCUMENTS

| | | | |
|---|---|---|---|
| 1,096,359 | 5/1914 | Dwight | 273/169 |
| 1,133,129 | 3/1915 | Govan | 273/171 |
| 1,825,244 | 9/1931 | Nero | 273/170 |
| 1,840,924 | 1/1932 | Tucker | 273/171 |
| 2,432,450 | 12/1947 | Sears | 273/171 |
| 2,750,194 | 6/1956 | Clark | 273/171 |
| 3,589,731 | 6/1971 | Chancellor | 273/170 |
| 3,743,297 | 7/1973 | Dennis | 273/171 X |
| 3,817,522 | 6/1974 | Simmons | 273/167 J X |
| 4,895,371 | 1/1990 | Bushner | 273/171 X |
| 5,046,740 | 9/1991 | D'Eath | 273/170 X |

FOREIGN PATENT DOCUMENTS

| | | | |
|---|---|---|---|
| 2337985 | 2/1975 | Fed. Rep. of Germany | 273/170 |
| 346671 | 4/1931 | United Kingdom | 273/171 |

OTHER PUBLICATIONS

"Golf Digest", Magazine, Apr. 1972 issue, Advertisement for DYNA-RANGE, p. 106.

*Primary Examiner*—William H. Grieb
*Assistant Examiner*—Sebastiano Passaniti
*Attorney, Agent, or Firm*—Leon Gilden

[57] ABSTRACT

A golf club head includes a rearwardly extending head portion, with a rear face spaced from a forward face of the golf club head, with the rear face including a bore projected therefrom into the golf club head, with the bore accommodating weight members therewithin to effect modification of an associated golf club head. A modification of the invention includes selective displacement of a single or plurality of weights within the golf club head and bore to effect modification of a center of gravity defined by the golf club head.

5 Claims, 4 Drawing Sheets

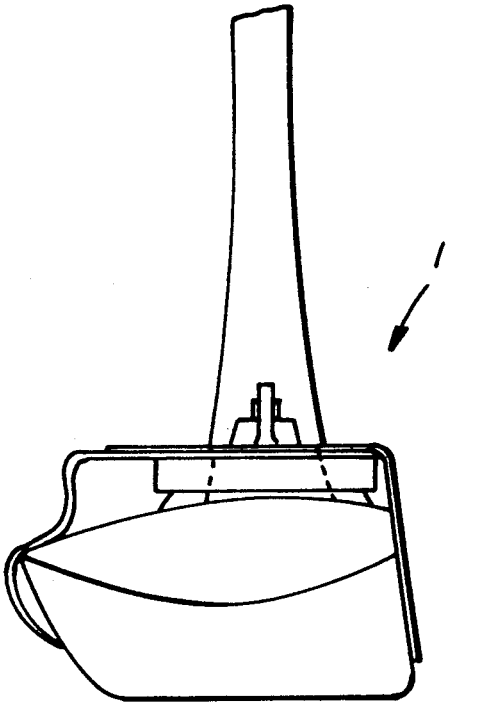
Fig 1
PRIOR ART
Fig 2
PRIOR ART
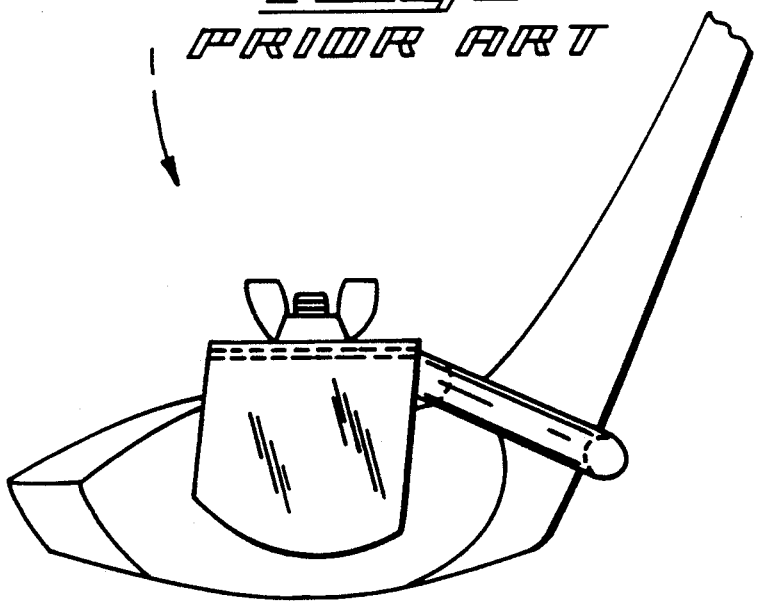

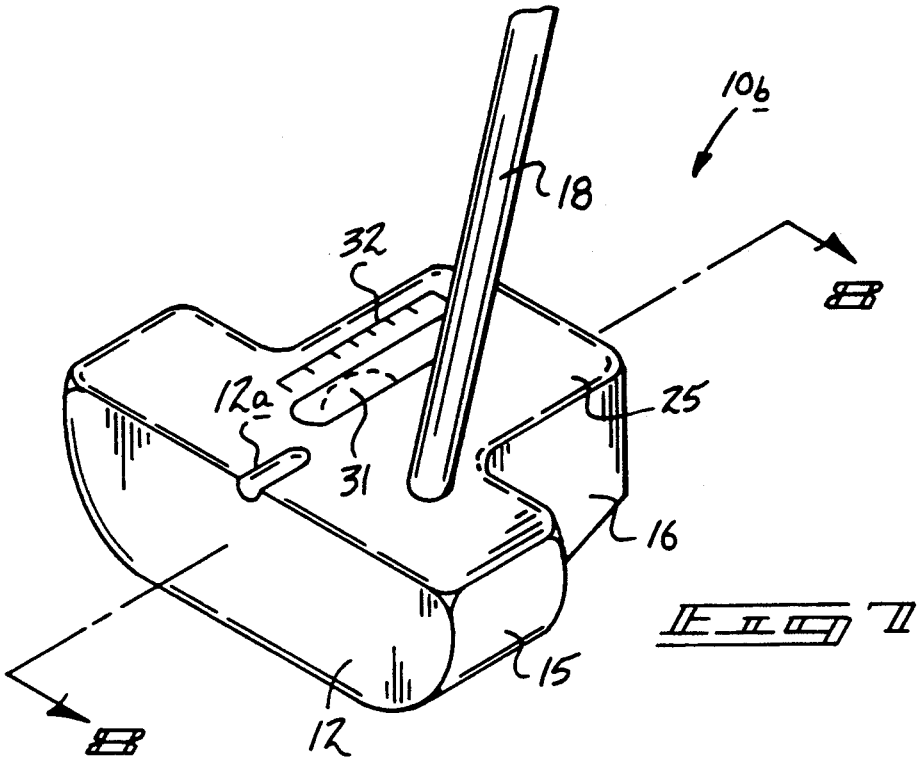
Fig 7
Fig 8
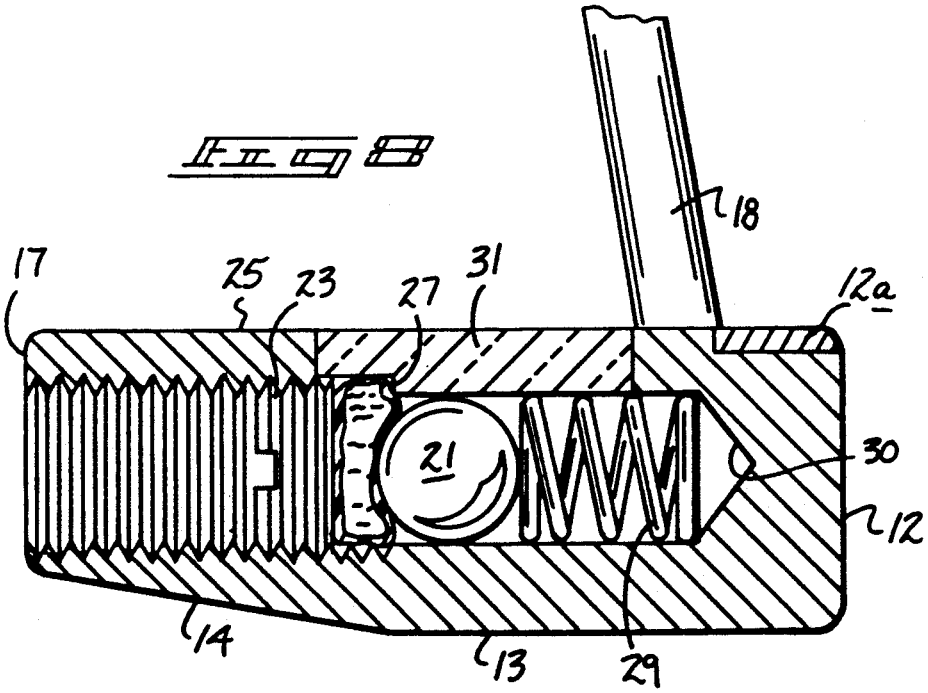

GOLF CLUB HEAD WEIGHT MODIFICATION APPARATUS

BACKGROUND OF THE INVENTION

1. Field of the Invention

The field of invention relates to golf club apparatus, and more particularly pertains to a new and improved golf club head weight modification apparatus wherein the same permits effective varying of a golf club head weight and a center of gravity thereof with respect to the golf club head.

2. Description of the Prior Art

It is desired to, at times, modify a weight load of the head of a golf club for exercise, practice, and enhanced tailoring of the golf club and head relative to an individual by modification of the weight and its center of gravity relative to an existing golf club. Prior art apparatus for weight modification has been presented in the prior art and includes U.S. Pat. No. 3,133,735 to Greenshieldes setting forth a golf club weight attachment for straddling a top surface of a golf club.

U.S. Pat. No. 4,715,606 to Varley sets forth a golf club and weight control structure wherein a foldable material is positioned within a hollow space of the striker head by way of a closure arranged in the region of the golf club shaft.

U.S. Pat. No. 4,213,614 to Philippi sets forth a golf club weight attachment arranged for surmounting a top surface of an associated golf club head.

U.S. Pat. No. 3,419,275 to Winkleman sets forth a putter head with a magnetic weight member for effecting weight adjustment thereof.

As such, it may be appreciated that there continues to be a need for a new and improved golf club head weight modification apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of golf club apparatus now present in the prior art, the present invention provides a golf club head weight modification apparatus wherein the same permits repositioning and altering of the center of gravity and total weight of an associated golf club head. As such, the general purpose of the present invention, which will be described subsequently in greater detail, is to provide a new and improved golf club head weight modification apparatus which all the advantages of the prior art golf club apparatus and none of the disadvantages.

To attain this, the present invention provides a golf club head including a rearwardly extending head portion, with a rear face spaced from a forward face of the golf club head, with the rear face including a bore projected therefrom into the golf club head, with the bore accommodating weight members therewithin to effect modification of an associated golf club head. A modification of the invention includes selective displacement of a single or plurality of weights within the golf club head and bore to effect modification of a center of gravity defined by the golf club head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf club head weight modification apparatus which has all the advantages of the prior art golf club apparatus and none of the disadvantages.

It is another object of the present invention to provide a new and improved golf club head weight modification apparatus which may be easily and efficiently manufactured and marketed.

It is a further object of the present invention to provide a new and improved golf club head weight modification apparatus which is of a durable and reliable construction.

An even further object of the present invention is to provide a new and improved golf club head weight modification apparatus which is susceptible of a low cost of manufacture with regard to both materials and labor, and which accordingly is then susceptible of low prices of sale to the consuming public, thereby making such golf club head weight modification apparatus economically available to the buying public.

still yet another object of the present invention is to provide a new improved golf club head weight modification apparatus which provides in the apparatuses and methods of the prior art some of the advantages thereof, while simultaneously overcoming some of the disadvantages normally associated therewuth.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic frontal view of a prior art golf club weight modification apparatus.

FIG. 2 is an orthographic side view of the prior art structure, as set forth in FIG. 1.

FIG. 7 is an isometric illustration of a further modification of the invention.

FIG. 8 is an orthographic view, taken along the lines 8—8 of FIG. 7 in the direction indicated by the arrows.

DESCRIPTION OF THE PREFERRED EMBODIMENT

Figure 3:
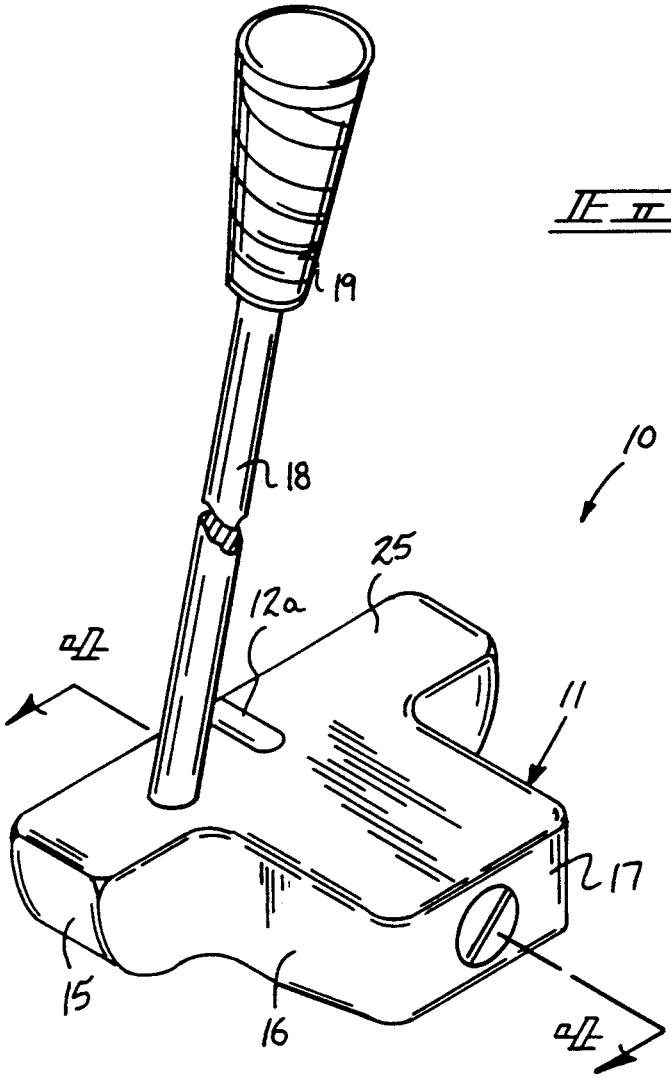
FIG. 3 is an isometric illustration of the instant invention.
Figure 4A:
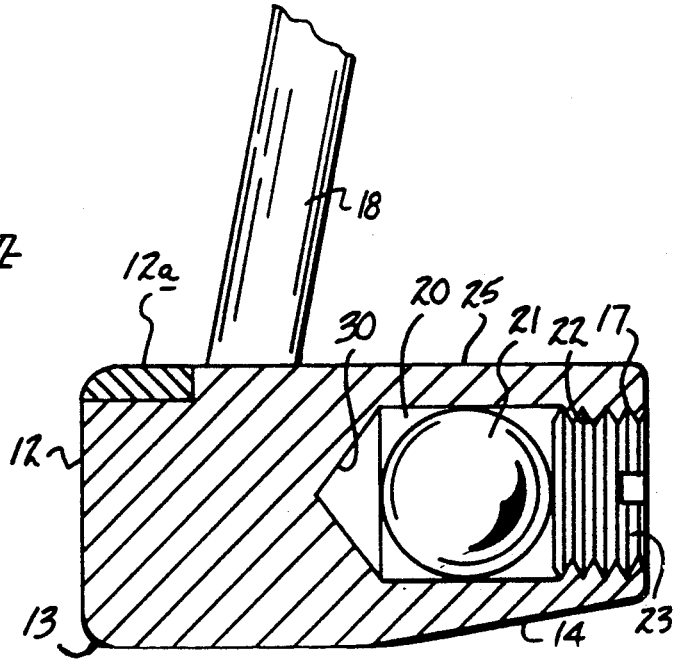
FIG. 4 is an orthographic view, taken along the lines 4—4 of FIG. 3 in the direction indicated by the arrows.

With reference now to the drawings, and in particular to FIGS. 1 to 8 thereof, a new and improved golf club head weigh modification apparatus embodying the principles and concepts of the present invention and generally designated by the reference numerals 10, 10*a*, and 10*b* will be described.

FIGS. 1 and 2 illustrate a prior art golf club weight modification apparatus, as set forth in U.S. Pat. No. 3,133,735, wherein a weight member and associated bracket structure is mounted to an uppermost portion of an associated golf club head.

More specifically, the golf club head weight modification apparatus 10 of the instant invention essentially comprises a golf club including a striker head 11, with the striker head including a striker face 12, with a bottom wall including a first bottom wall (13) defined by a first length, and a second bottom wall defined by a second length. A first side wall (15) extends above the bottom wall and rearwardly of the striker face the first length, with a second side wall extending in a spaced relationship relative to the first side wall the second length, wherein the second bottom wall 14 is inclined upwardly relative to the first bottom wall to define a clearance spacing minimizing ground contact during swinging of the golf club head and associated golf club. A rear wall 17 is defined between spaced second side walls 16, with a top wall 25 coextensively directed from the striker face 12 to the rear wall 17. A club shaft 18 is fixedly mounted to the club head extending through the top wall 25. A striker face indicator plug 12*a* is positioned on the top wall 25 orthogonally oriented relative to the striker face 12 for visual indication of medial orientation of the striker face relative to a golf ball (not shown) to be struck. Conventionally, a hand grip member 19 is mounted in surrounding relationship relative to an upper end portion of the club shaft 18.

The rear wall 17 includes a rear wall cavity bore 20 directed interiorly of the golf club head extending or originating from the rear wall 17. A spherical weight member 21 is provided for selective positioning within the rear wall cavity bore, wherein an internally threaded bore portion 22 extending interiorly of the bore is cooperative with an externally threaded bore plug 23. In this manner, the weight member 21 is selectively positioned within the bore 20 adjacent the bore's forward end 30 to provide additional weight to the golf club in use. It is understood that various densities of weight members 21 may be provided to alter the positioning of and total weight differential afforded the golf club head.

Figure 5:
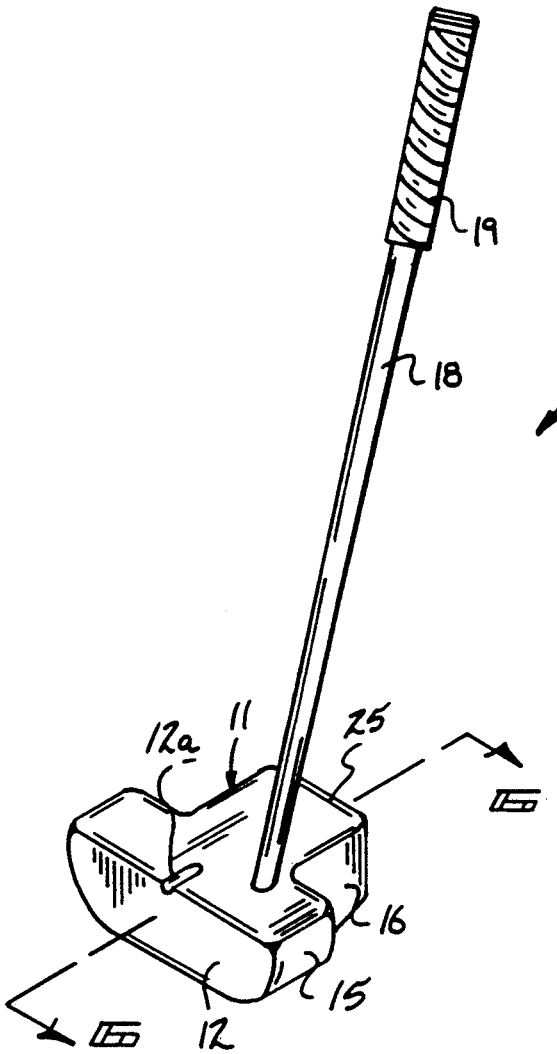
FIG. 5 is an isometric illustration of a modification of the invention.
Figure 6:
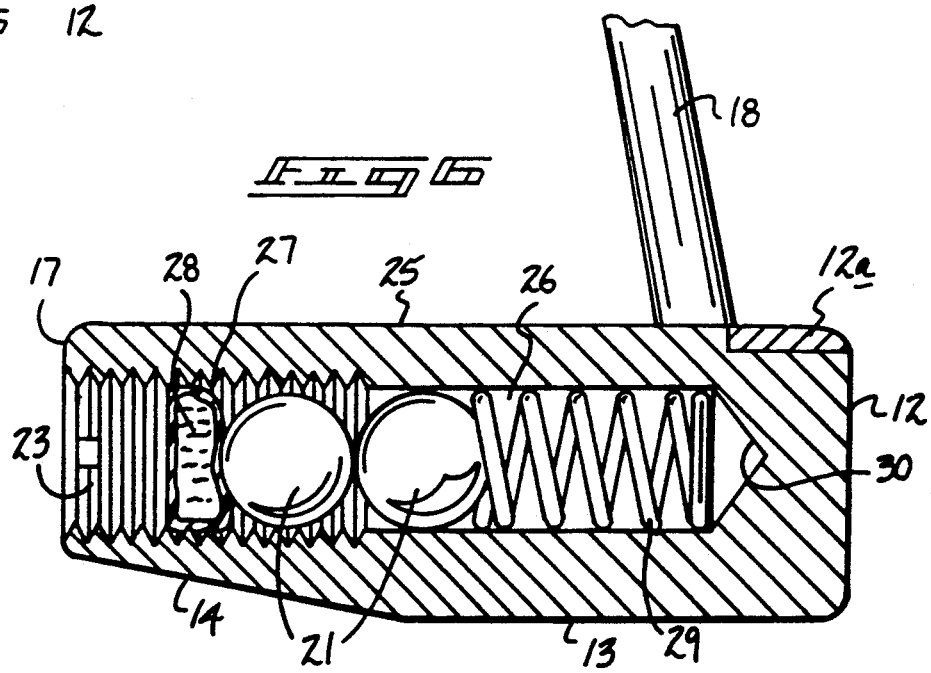
FIG. 6. is an orthographic view, taken along the lines 6—6 of FIG. 5 in the direction indicated by the arrows.

FIGS. 5 and 6 illustrate a modified apparatus 10*a*, wherein the internally threaded modified cavity bore 26 includes the internal threads extending a longitudinal extent into the bore extending from the rear wall 17, with a flexible container 27 mounted in contiguous communication between a weight member 21 and the bore plug 23. The flexible container 27 includes a compressible fluid 28 whereupon impact of the striker face 12 with a golf ball, the compressible fluid 28 accommodates shock directed through the shaft 18. Further, a spring member 29 is captured between the bore forward end 30 and the weight member 21 permitting the externally threaded bore plug 23, defined by a first axial length, to be threaded into the internally threaded bore portion 22 defined by a second axial length. As a second axial length is substantially greater than the first axial length, positioning of a single or plurality of the weight members 21 as desired within the golf club head provides not only modification of the total weight of the golf club head, but the center of gravity of the golf club head due to the weight being displaced as required within the golf club head to accommodate variations among individuals in weight displacement within the golf club head to improve swing of the golf club and the like.

The further modification of the apparatus 10*b*, as set forth in FIGS. 7 and 8, includes an addition to the modification 10*a*, a transparent indicator lens 31 positioned coaxially with and above the bore 26 within the top wall 25. A graduation gauge 32 is positioned coextensively with the indicator lens 31 for visual indication of exact positioning of the weight member or members 21 within the cavity bore 26 permitting fine adjustment of the weights within the cavity bore and permitting a repetitive ability of an individual to replicate the positioning of the weights within a bore relative to an improved swing of the golf club and other such considerations.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club head weight apparatus, comprising in combination, a golf club head, the golf club head including a striker face, and a first bottom wall oriented coextensively relative to the striker face and positioned therebelow, with a second bottom wall extending rearwardly from the first bottom wall, and the second bottom wall being inclined and oriented above a plane containing the first bottom wall, and a rear wall, the rear wall oriented at a rear terminal edge of the second bottom wall and spaced from the striker face, and a top wall coextensively directed from the striker face to the rear wall, and a club shaft integrally mounted to the club head through the top wall, and a rear cavity bore directed into the club head originating from the rear wall and extending to a bore forward end positioned adjacent and in a spaced relationship relative to the striker face within the club head, and the bore including an internally threaded bore portion extending into the bore from the rear wall a predetermined second axial length, and an externally threaded bore plug threadedly receivable within the internally threaded bore portion defined by a first axial length, and the second axial length being greater than the first axial length, and at least one weight member receivable within the bore between the bore plug and the bore forward end, and a spring member positioned between the weight member and the bore forward end to permit the externally threaded bore plug to be selectively threaded into the internally threaded bore portion by the second axial length.

2. An apparatus as set forth in claim 1 wherein a flexible container is mounted between the weight member and the bore plug within the bore, and the flexible container includes a compressible fluid to accommodate impact upon the striker face impacting with a golf ball.

3. An apparatus as set forth in claim 2 wherein the top wall includes a transparent indicator lens mounted within the top wall overlying the bore.

4. An apparatus as set forth in claim 3 including a gradation gauge imposed upon the top wall adjacent to and coextensive with the transparent indicator lens.

5. An apparatus as set forth in claim 4 including an indicator plug mounted to the top wall orthogonally oriented to and medially intersecting the striker face.

* * * * *